US007033283B2

(12) United States Patent
Kang

(10) Patent No.: US 7,033,283 B2
(45) Date of Patent: Apr. 25, 2006

(54) GOLF PUTTER

(76) Inventor: Sock Jhin Kang, Asiaseonsuchon APT 7-dong 303ho, Jamsil-dong Songpa-gu, Seoul (KR)

( * ) Notice: Subject to any disclaimer, the term of this patent is extended or adjusted under 35 U.S.C. 154(b) by 23 days.

(21) Appl. No.: 10/856,067

(22) Filed: May 28, 2004

(65) Prior Publication Data

US 2004/0242338 A1 Dec. 2, 2004

(30) Foreign Application Priority Data

May 30, 2003 (KR) ..... 20-2003-0016961

(51) Int. Cl.
*A63B 69/36* (2006.01)

(52) U.S. Cl. ..... 473/231; 473/236; 473/238; 473/242; 473/251

(58) Field of Classification Search ..... 473/330–331, 473/340–341, 236–255, 257, 265, 231; D21/736–746
See application file for complete search history.

(56) References Cited

U.S. PATENT DOCUMENTS

| | | | | | |
|---|---|---|---|---|---|
| 837,030 | A | * | 11/1906 | Blanchard | 473/201 |
| 1,678,750 | A | * | 7/1928 | Swan | 473/251 |
| 2,503,506 | A | * | 4/1950 | Miller | 473/251 |
| 2,820,638 | A | * | 1/1958 | Morrison | 473/252 |
| 3,077,350 | A | * | 2/1963 | Koorland | 473/251 |
| 3,333,854 | A | * | 8/1967 | White | 473/288 |
| 3,595,582 | A | * | 7/1971 | Chapman | 473/244 |
| D222,889 | S | * | 1/1972 | Dziurgot | D21/745 |
| 4,002,343 | A | * | 1/1977 | Eckert | 473/251 |
| 4,165,076 | A | * | 8/1979 | Cella | 473/325 |
| 4,712,797 | A | * | 12/1987 | Kovalchek | 473/251 |
| 5,226,654 | A | * | 7/1993 | Solheim | 473/313 |
| 6,062,987 | A | * | 5/2000 | Woodward | 473/251 |
| 6,099,413 | A | * | 8/2000 | Naylor | 473/226 |
| 6,520,865 | B1 | * | 2/2003 | Fioretti | 473/251 |
| D502,519 | S | * | 3/2005 | Kang | D21/759 |

FOREIGN PATENT DOCUMENTS

| | | |
|---|---|---|
| KR | 200195345 | 9/2000 |

* cited by examiner

*Primary Examiner*—Sebastiano Passaniti
(74) *Attorney, Agent, or Firm*—Ladas & Parry LLP

(57) ABSTRACT

A golf putter having a virtual hitting face frontward offset from an actual hitting face of a putter head is disclosed. The golf putter comprises a putter head having a hitting face, a toe part and a heel part, a hosel connected on the putter head, a shaft which is formed with a grip at an upper end thereof, a shaft receiving part connected to the hosel to receive a lower end of the shaft; and a virtual hitting position decision plate which, when a golfer look downward at the hitting face, covers the hitting face, and has a virtual hitting face at a position forwardly offset from the hitting face.

5 Claims, 2 Drawing Sheets

GOLF PUTTER

BACKGROUND OF THE INVENTION

1. Field of the Invention

The present invention relates to a golf putter, and more particularly to a putter having a virtual hitting face frontward offset from an actual hitting face of a putter head is disclosed.

2. Description of the Prior Art

A conventional golf putter generally comprises a putter head, a hosel, a shaft and a shaft receiving part. The putter head is formed with a hitting face for actually hitting a golf ball in a front side thereof. It is formed with a heel part and a toe part that provide a weight balance to both ends thereof in a rear side thereof. The hosel is formed on an upper side of the putter head. The shaft receiving part for receiving the shaft is formed on an upper end of the hosel.

Upon putting with the golf putter, if a golfer sets the hitting face, swings the putter and hits the golf ball, the golf ball is hit at pre-set position of the hitting face. If the pre-set hitting face and the actual hitting face are coincided at the same position, a point of application of a hitting force is positioned at a rear portion of the golf ball. As a result, the golf ball is hit while it is pushed at the back of the golf ball. Thus, there is a problem in that, since such a hit provides a backspin to the golf ball, the straight forwardness of a hitting direction of the golf ball is weakened, thus lowering a putting success ratio.

SUMMARY OF THE INVENTION

Therefore, the present invention has been made in view of the above problem, and it is an object of the invention to provide a golf putter having a simple structure for providing a hit for pulling a golf ball in front of the golf ball.

The above object is accomplished by a golf putter comprising: a putter head having a hitting face for hitting a golf ball, and a toe part and a heel part for providing a weight balance to both sides thereof in a rear side thereof; a hosel connected on the putter head; a shaft which is formed with a grip at an upper end thereof; a shaft receiving part connected to the hosel to receive a lower end of the shaft; and a virtual hitting position decision plate which, when a golfer look downward at the hitting face, covers the hitting face, and has a virtual hitting face at a position forwardly offset from the hitting face.

According to the above constitution, since an actual hitting is made after the virtual hitting face passes by the golf ball, the hitting face pulls the golf ball in front of the golf ball, thus largely providing topspin to the golf ball.

Here, preferably, the shaft receiving part may be disposed to be offset forwardly from the hosel.

Further, preferably, the virtual hitting position decision plate may have one side that is integrally joined on the putter head, and the other side that is formed with the virtual hitting face.

Meanwhile, in other embodiment, the virtual hitting position decision plate may have one side that is joined on the putter head by joining elements, and the other side that is formed with the virtual hitting face. Thus, it may be easily applied to a conventional putter.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

The present invention will be described in further detail by way of preferred embodiments with reference to the accompanying drawings.

Figure 1:
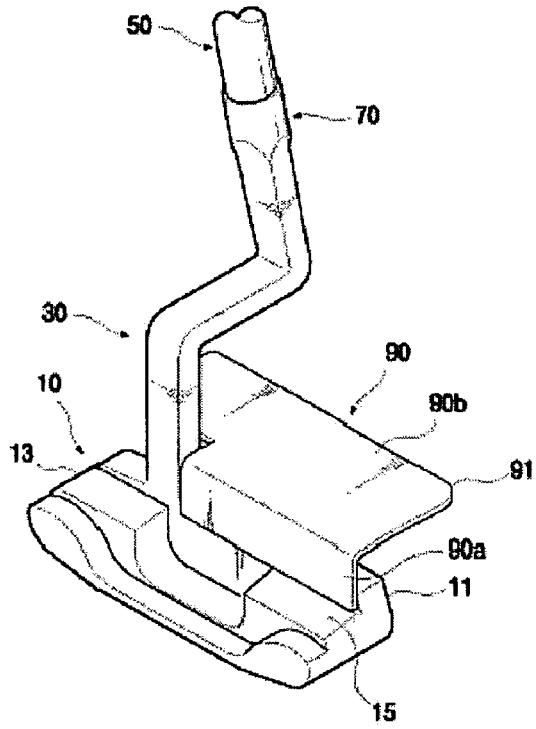
FIG. 1 is a perspective view for showing a golf putter according to a preferred embodiment of the invention.
Figure 2:
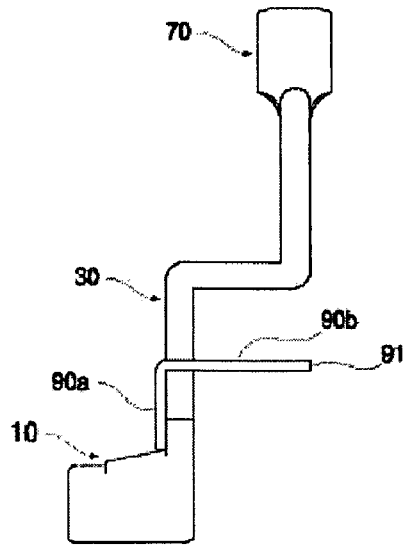
FIG. 2 is a side view of a golf putter shown in FIG. 1.
Figure 3:
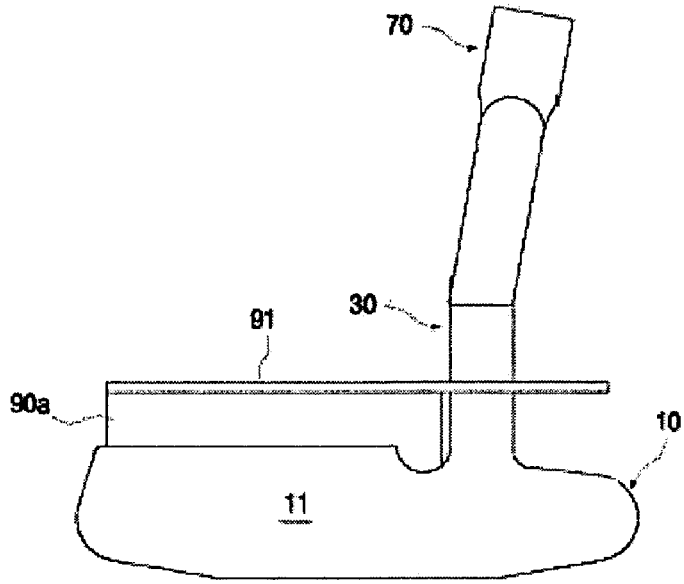
FIG. 3 is a front view of a golf putter shown in FIG. 1.

FIG. 1 is a perspective view for showing a golf putter according to a preferred embodiment of the invention, FIG. 2 is a side view of a golf putter shown in FIG. 1, and FIG. 3 is a front view of a golf putter shown in FIG. 1.

Referring to FIGS. 1 to 3, a golf putter according to the embodiment comprises a putter head 10, a hosel 30 connected on the putter head 10, a shaft 50, a shaft receiving part 70, and a virtual hitting position decision plate 90 mounted on the putter head 10.

The putter head 10 is formed with a hitting face 11 for actually hitting a golf ball at a front side thereof, while it is formed with a toe part 13 and a heel part 15 for employing a toe-heel balance principle to increase a inertia moment at a rear side thereof.

The hosel 30 is extended upwardly from a portion adjacent to the heel part 15. Further, the shaft receiving part 70 for receiving the shaft 50 is connected to an upper end of the hosel 30.

Figure 4:
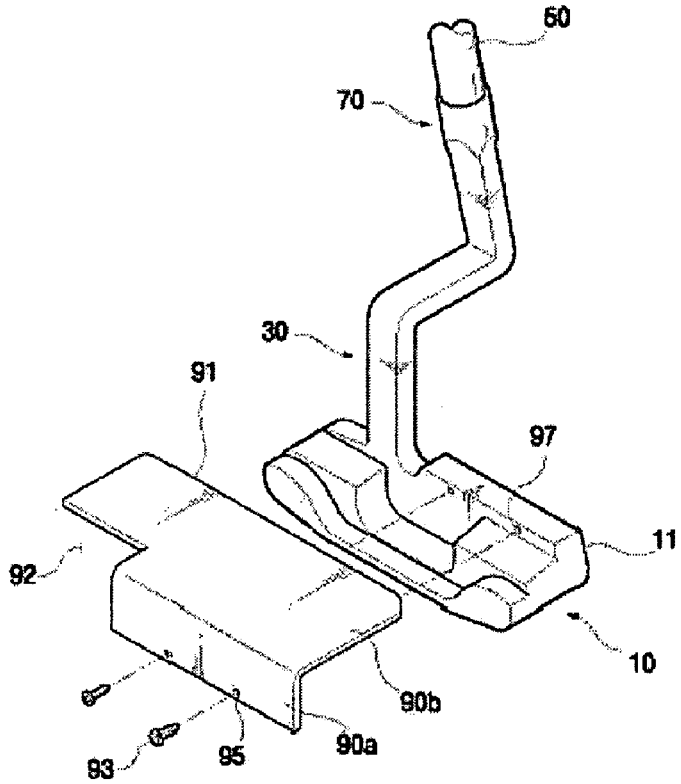
FIG. 4 is an exploded perspective view of a golf putter according to a preferred embodiment of the invention.

Preferably, the virtual hitting position decision plate 90, as shown in FIGS. 3 and 4, may comprise an upper projecting plate 90*a* and a front projecting plate 90*b* that are bended to form a bended plate. That is, a lower end of the upper projecting plate 90*a* is integrally joined to the putter head 10, more preferably the rear side of the hitting face 11. The front projecting plate 90*b* is formed with a virtual hitting face 91 at a free end thereof.

According to the above bended constitution, when a golfer look downward at the hitting space, since the front projecting plate 90*b* covers the front side of the putter head 10, the hitting face 11 is not seen. Here, preferably, the virtual hitting position decision plate 90 may be formed with a receiving part for receiving the hosel 50 to entirely cover the hitting face.

Further, preferably, the hitting face 11 may be spaced from the virtual hitting face 19 by a distance enough to cover a half of the golf ball or more.

According to the above constitution, the golfer sets a hitting point against the golf ball using the virtual hitting face 91. The virtual hitting face 91 is offset forwardly from the hitting face 11. Thus, since the golfer hits the golf ball while looking at the virtual hitting face 91 without seeing the hitting face 11, a point of time when the golf ball is hit by the hitting face 91 is made after passing by the virtual hitting face 91. As a result, since the hitting face 11 hits a portion positioned upwardly from the center of the golf ball, it naturally pulls the golf ball in front of the golf ball. Thus, since the topspin is spontaneously applied to the golf ball, the forward straightness is enhanced. This is the same as a principle that, when taking a running approach for a short distance around the green, the gofer should take a posture of the hand first for extremely going hands, which are a point of application of a hitting force, before the golf ball to induce straightforwardness and a top spin.

The virtual hitting position decision plate 90 may be integrally molded on the putter head 10 by casting, and so on. Further, it may be integrally realized by a welding.

Meanwhile, preferably, as shown in FIG. 2, a longitudinal direction of the shaft receiving part 70 may be placed on a line extended from the virtual hitting face 91 by doubly bending the hosel 30. This causes a center of weight of the golfer to be located in front of the golf ball, while concentrating the golfer' eyes at the virtual hitting face 91. Thus, effect for forwardly pulling the golf ball may be doubled.

Further, preferably, the hosel 30 having the shaft receiving part 70 may be inclined at about 10 degrees toward the golfer.

From the foregoing, the virtual hitting position decision plate 90 may be integrally manufactured along with the putter head 10, while it may be simply mounted to a conventional putter head for practicing putting. Referring to FIG. 4, the virtual hitting position decision plate 90 is detachably mounted to the putter head 10.

Referring again to FIG. 4, the virtual hitting position decision plate 90 consists of the upper projecting plate 90*a*, the front projecting plate 90*b* and a joining element. The joining element may be realized by integrally constituting the putter head 10 and the virtual hitting position decision plate 90. Further, as shown in FIG. 4, the joining element may be a screw, a magnet, or a bonding agent.

In order to join by the screw 93, the front projecting plate 90*a* is formed with a joining hole 95. Here, preferably, the putter head 10 is formed with a female screw part 97 corresponded to the joining hole 95.

The foregoing invention has been described in terms of preferred embodiments. However, those skilled, in the art will recognize that many variations of such embodiments exist. Such variations are intended to be within the scope of the invention and the appended claims.

From the foregoing, according to the golf putter according to an embodiment of the invention, there are effects as follows.

Firstly, the invention provides the putter head having the virtual hitting position decision plate that covers the hitting face, when the golfer look downward at the hitting face, and has the virtual hitting face at the position forwardly offset from the hitting face. Thus, since, after passing by a distance offset from the virtual hitting face, the golf ball is hit, and then the actual hitting surface pulls the golf ball in front of the golf ball, the topspin largely applies to the golf ball, thus enhancing a straight forwardness of the hitting direction, and increasing a putting success ratio. Further, since the hitting face is covered, the eyes of the gofer are concentrated at the virtual hitting face. Thus, the putting success ration may be considerably increased.

Secondly, the invention provides the putter having the shaft receiving part disposed to be offset forwardly from the hosel. Thus, since the longitudinal direction of the shaft is located on a line extended from the virtual hitting face, the eyes of the golfer can be more concentrated at the virtual hitting face. Further, since a center of the weight of the golfer is placed before the golf ball, the effect for pulling forwardly the golf ball can be doubled.

Thirdly, since one side of the virtual hitting position decision plate is integrally joined on the putter head, and the other side of the virtual hitting position decision plate is formed with the virtual hitting face, the golf putter having the virtual hitting position decision plate may be simply manufactured.

Lastly, the invention provides the virtual hitting position decision plate so that the one side thereof is joined on the putter head by the joining elements, and the other side thereof is formed with the virtual hitting face, it is simply applied to the putter head upon practicing putting, and commonly applied to the conventional putter head.

What is claimed is:

1. A golf putter comprising:

a shaft having a lower end and an upper end formed with a grip;

a puffer head comprising a hitting face for hitting a golf ball;

a hosel having two ends, the first end being connected to the putter head and the second end being a shaft receiving part receiving the lower end of the shaft;

a virtual hitting position decision plate having a forward edge and a rear edge having a width of greater than 2.1 centimeters between the two edges, wherein the rear edge is connected to an upper portion of the hitting face to obscure the hitting face from the view of a standing golfer holding the shaft and to obscure more than half the golf ball from the view of the standing golfer holding the shaft when the golf ball left on ground is in contact with the hitting face oriented perpendicular to the ground, and wherein the shaft receiving part of the hosel is offset more than 2.1 centimeters away from the hitting face and lines up with the forward edge of the virtual position decision plate.

2. The golf puller according to claim 1, wherein the virtual hitting position decision plate has one side that is integrally joined on the putter head, and the other side that is formed with the virtual hitting face.

3. The golf putter according to claim 1, wherein the virtual hitting position decision plate has one side that is joined on the puller head by joining elements, and the other side that is formed with the virtual hitting face.

4. The golf putter according to claim 1, wherein the putter head further comprises a toe part and a heel part for providing a weight balance to both sides of the hitting face.

5. The golf putter according to claim 1, wherein the width between the forward and rearward edges of the virtual hitting position decision plate is more than 4.2 centimeters to obscure the entire golf ball from the view of a standing golfer holding the shaft when the golf ball left on ground contacting the hitting face oriented perpendicular to the ground, and wherein the shaft receiving part of the hosel is offset more than 4.2 centimeters away from the hitting face such that, when the offset equals the width of the virtual hitting position decision plate, the shaft receiving part lines up with the forward edge of the virtual position decision plate.

* * * * *